United States Patent [19]

Brophy

[11] Patent Number: 4,771,212

[45] Date of Patent: Sep. 13, 1988

[54] HIGH VOLTAGE GAS ISOLATOR

[75] Inventor: John R. Brophy, Valencia, Calif.

[73] Assignee: The United States of America as represented by the Administrator of the National Aeronautics and Space Administration, Washington, D.C.

[21] Appl. No.: 102,946

[22] Filed: Sep. 30, 1987

[51] Int. Cl.[4] ..... H01J 9/24; H01J 17/16

[52] U.S. Cl. ..... 313/231.01; 313/362.1; 313/612; 445/23; 60/202

[58] Field of Search ..... 313/362.1, 612, 231.01; 315/111.01, 111.11; 60/202; 445/22, 23

[56] References Cited

U.S. PATENT DOCUMENTS

| | | | |
|---|---|---|---|
| 3,064,156 | 11/1962 | Pittman | 313/612 X |
| 3,138,919 | 6/1964 | Deutsch | 60/35.6 |
| 3,159,967 | 12/1964 | Webb | 60/35.5 |
| 3,336,748 | 8/1967 | Nakanishi et al. | 60/202 |
| 3,576,107 | 4/1971 | Nakanishi | 60/202 |

*Primary Examiner*—Palmer C. DeMeo

*Attorney, Agent, or Firm*—Paul F. McCaul; Thomas H. Jones; John R. Manning

[57] ABSTRACT

An isolator is provided which has an inlet at ground electrical potential which receives gas, and which has an outlet at a high electrical potential through which gas is discharged, the isolator being compactly and simply constructed while providing a long narrow path that minimizes the possibility of electrical breakdown through the gas. The isolator includes a first element forming a cylindrical core and a cup-shaped second element forming a sleeve portion that closely receives the core. The core has a helical groove on its outside to form a passage between the groove and the inner walls of the sleeve. The core also has a vertical hole extending to the bottom of the core and a radial groove in the bottom of the core that extends between the hole and the bottom of the helical groove.

6 Claims, 1 Drawing Sheet

FIG. 1
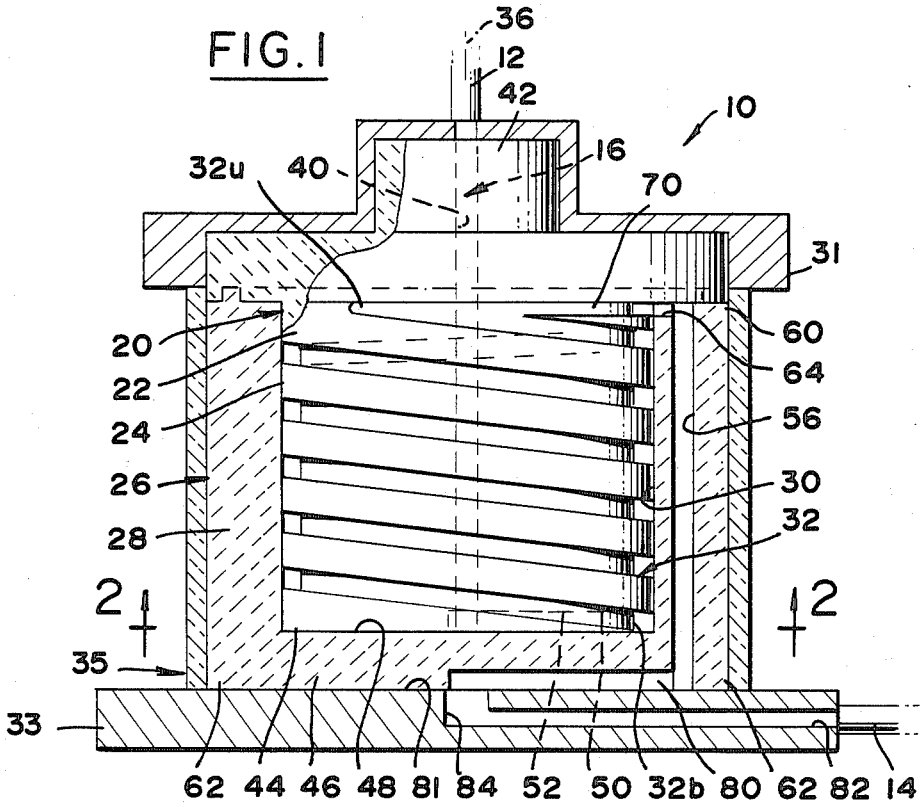
FIG. 4
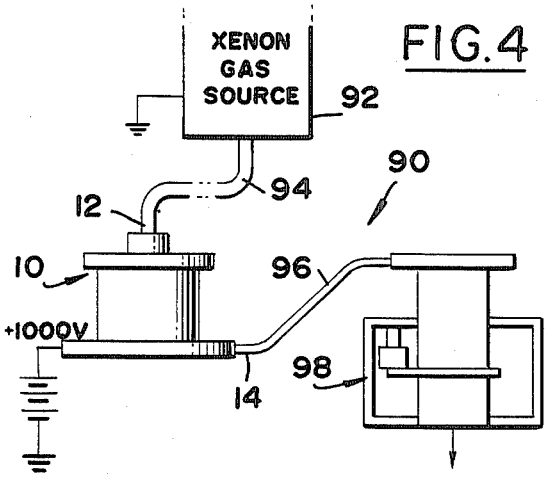
FIG. 2
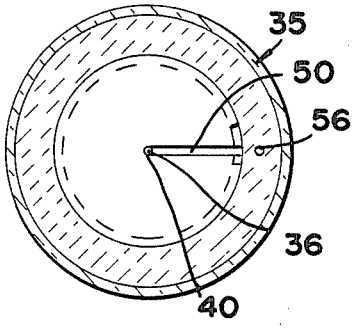
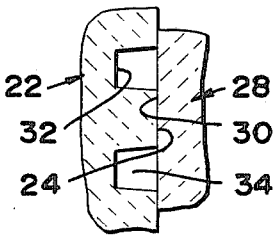
FIG. 3

HIGH VOLTAGE GAS ISOLATOR

ORIGIN OF THE INVENTION

The invention described herein was made in the performance of work under a NASA contract, and is subject to the provisions of Public Law 96-517 (35 USC 202) in which the Contractor has elected not to retain title.

BACKGROUND OF THE INVENTION

Rapidly propelled gas is used in ion thrusters to accelerate space vehicles and in systems for implanting ions in semiconductors and other materials. To accelerate the gas, it is generally first brought from a source at ground potential to a high potential where acceleration of the gas occurs. As the gas moves between ground and a high potential, ionization occurs which can lead to uncontrolled current conduction through the gas. Such current flow is minimized by providing an isolator between the two widely different potentials, the isolator typically forming a long tube of insulative or dielectric material. U.S. Pat. No. 3,576,107 describes an isolator formed by deep interfitting cylinders that have deep concentric grooves. The formation of such deep concentric grooves is difficult, and results in wide passages. It is desirable to form the passages with a large surface area per unit length, to maximize recombination of ions and electrons so as to minimize the conductivity of the gas. A gas isolator which was of simple and compact construction, and which provided a very long and narrow passage through which gas passes between locations of widely different potential, would be of considerable value.

SUMMARY OF THE INVENTION

In accordance with one embodiment of the present invention, a high voltage gas isolator is provided, which is compact and relatively easy to construct, and which provides a long, narrow passage for gas. The isolator includes a first element having a core of dielectric material with a cylindrical periphery, and a second element which includes a sleeve of dielectric material forming a cylindrical hole which closely receives the cylindrical core. The core has a largely helical groove in its periphery, which forms a helical passage in the space between the core and the sleeve. The core can have a flat bottom wall, and the second element can be cup-shaped to form a bottom inside surface lying facewise against the core wall. The core has a through hole extending to its bottom surface, and a groove in its bottom surface extending to the bottom of the helix; a bottom passage is formed between the groove at the bottom of the core and the bottom inside surface of the cup-shaped second member.

One end of the largely helical groove can end in a circular groove portion which communicates with a passage formed in the sleeve. The circular groove portion assures coupling despite slight angular misalignment of the first and second elements.

The novel features of the invention are set forth with particularity in the appended claims. The invention will be best understood from the following description when read in conjunction with the accompanying drawings.

BRIEF DESCRIPTION OF THE DRAWINGS

FIG. 1 is a sectional view of a high voltage gas isolator constructed in accordance with the present invention.

FIG. 2 is a view taken on the line 2—2 of FIG. 1.

FIG. 3 is an enlarged view of a portion of the isolator of FIG. 1.

FIG. 4 is a simplified view of an ion thruster which uses the isolator of FIG. 1.

DESCRIPTION OF THE PREFERRED EMBODIMENTS

FIG. 1 illustrates a high voltage gas isolator 10 which includes a gas inlet 12 at a predetermined potential such as ground (0 volts) and a gas outlet 14 which is at a high potential compared to the inlet, such as +1000 volts. A gas such as xenon must pass through the isolator, without breakdown of the gas which would cause a high current flow through it between the 1000 volt outlet and the 0 volt inlet. Avoidance of such breakdown is enhanced by providing a passageway or conduit 16 through the isolator, which is of long length and which is configured to minimize the propagation of a potential breakdown.

The isolator includes a first element 20 having a core portion or core 22 with a cylindrical periphery 24. A second element 26 includes a sleeve 28 having a cylindrical hole 30 that closely receives the cylindrical periphery 24 of the core. The periphery 24 of the core is formed with a largely helical groove 32. As also shown in FIG. 3, the walls of the sleeve hole 30 closely receive the periphery 24 of the core. As a result, a largely helical passage 34 is formed between the walls of the groove 32 and the inside walls of the sleeve hole 30. A pair of end plates 31, 33 (FIG. 1) of electrically conductive material are electrically coupled to the inlet 12 and outlet 14. A dielectrical frame 35 surrounds the first and second elements and extends between the end plates.

The core 22 has an axis 36 centered on the core periphery. The first element 20 includes a largely vertical through hole 40 extending between a top end 42 of the first element, and the opposite bottom end 44 of the element which forms the bottom of the core. It may be noted that while the terms "top" and "bottom" may be used herein, these terms are used to describe the parts as they appear in the drawings and not necessarily as they may be oriented in actual use. The bottom end 44 of the core extends in a plane substantially perpendicular to the axis 36. The second element 26 is cup-shaped, and includes a bottom wall 46 with an upper surface 48 that lies closely facewise adjacent to the lower end 44 of the core. A bottom groove 50 is formed in the lower end 44 of the core, and extends substantially radial to the axis 36, between the bottom of the vertical hole 40 and the bottom **32*b* of the largely helical groove at the periphery of the core. The bottom groove 50 forms part of the walls of a bottom passage 52 through which gas can flow. The rest of the walls of the bottom passage are formed by the upper surface 48** of the second elements.

The second element includes a largely vertical hole 56 that extends largely parallel to the axis 36, and which extends between the upper and lower ends 60, 62 of the second element. The upper end of the hole 56 is coupled to the top of the largely helical groove through a largely horizontal hole or groove 64 at the top of the sleeve of the second element. The upper end **32*u*** of the largely helical groove ends in a circular groove portion 70 that is coupled to the groove 64 at the top of the sleeve. Although it would be possible to couple the sleeve groove 64 to the top of the helical portion of the groove at 32*u*, good flow of gas between them would require accurate angular alignment of the two elements 20, 26 about the axis 36. Although the parts can be easily made with high precision, it is more difficult to assure accurate angular alignment of the parts. Inclusion of the circular groove 70 assures coupling despite angular misalignment in assembly of the parts.

The second element includes a radial groove 80 in its lower end 62, which extends from the bottom of the vertical hole 56 to the axis 36. The radial groove 80 forms a radial passageway, together with the upper surface 81 of the lower plate 33. The lower plate 33 has a radial passage 82 extending to the axis and a substantially axially extending hole 84 extending to the upper surface of the bottom plate to connect to the radial groove 80 in the second element. Such connection at the axis also avoids the need for precision angular alignment of parts.

Most of the length of the passageway or conduit 16 that couples the gas inlet 12 to the outlet 14, extends along the largely helical groove at the periphery of the core. It is relatively easy to form such a helical groove, as by using thread cutting techniques. The forming of the radial grooves 50, 64, and 80 on flat surfaces of the elements is also relatively easy to accomplish, as by the use of a small diameter end mill. The forming of the through holes 40, 56 in the elements is easy to perform, as by drilling. Thus, a long, narrow passageway is easily formed through the isolator, using relatively simple machining methods. The relatively shallow grooves and small holes in the elements do not detract significantly from the strength and reliability of the elements.

In an isolator that applicant has constructed and tested, the first and second elements 20, 26 were formed of born nitride, which is a dielectric material that is relatively easy to machine. The end plates 31, 33 were formed of kovar, an alloy of nickel, cobalt and iron, and the frame 35 was formed of alumina. The core had a diameter of 0.800 inch and a length of 0.750 inch. The largely helical groove 32 was of largely square cross section, with a width and depth each of 0.040 inch, the groove being formed at a pitch of 6 per inch. The core and sleeve are interfitted with a clearance of about 0.002 inch.

The avoidance of electrical breakdown along the gas-carrying passageway is enhanced by providing sharp turns in the passageway that encourage recombination of ions and electrons. A sharp turn is provided at the intersection at 32*u* of the helical passageway, which carries gas clockwise as seen from the top of the isolator along the axis 36, and the circular groove at 70 which carries gas counterclockwise from the location 32*u*. Additional fairly sharp changes in direction occur along the isolator.

FIG. 4 shows the isolator 10 as part of an ion propulsion system 90. A xenon gas source 92 which is at ground potential, is coupled through a conduit 94 to the inlet 12 of the isolator. The outlet 14 of the isolator is coupled through a conduit 96 to an ion accelerator 98 which accelerates ions of the gas to a high velocity. As mentioned earlier, ion acceleration of gas is also useful in injecting ions in material to change their characteristics.

Thus, the invention provides a gas isolator for avoiding electrical breakdown along a path taken by gas in moving between locations of large electrical potential difference, in a compact and easily manufactured device. The isolator includes a cylindrical core with a largely helical groove, the core closely fitting into the cylindrical hole of a sleeve, so the walls of the core and sleeve form a portion of the gas passage. Grooves formed in the lower face of the core and in the lower face of a second element which includes the sleeve, provide passageways, in conjunction with other surfaces that couple to opposite ends of the largely helical passage. The need for precision angular alignment of parts is avoided by providing a circular groove portion to connect to a hole in the sleeve, and by extending a groove at the bottom of the second element to its axis.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A high voltage gas isolator comprising:

a first element of dielectric material having an axis and forming a core with a largely cylindrical outer surface centered on said axis said core having a bottom core surface extending in a plane substantially perpendicular to said axis;

a second largely cup-shaped element of dielectric material which includes a sleeve that closely surrounds said core and a cup bottom with an upwardly-facing surface that lies facewise against said bottom core surface;

said core having a hole extending substantially parallel to said axis to said bottom core surface, a groove in said bottom core surface extending to said cylindrical outer surface, and a largely helical groove in said cylindrical outer surface having a lower end communicating with said groove in said bottom core surface and an opposite upper end; and means including electrically conductive elements, forming passageways communicating with said core hole and the upper end of said largely helical groove, for passing gas therethrough.

2. The isolator described in claim 1 wherein:

said second element has a largely radial hole which communicates with the upper end of said largely helical groove, and said largely helical groove has a circular upper end.

3. A method for forming a high voltage gas isolator comprising:

forming a first element of dielectric material with a cylindrical core having a cylindrical outer surface and upper and lower ends, and forming a second element of dielectric material with a cylindrical hole of the same diameter as said core and a bottom surface at the bottom of said hole;

forming a largely helical groove having an upper end in said core outer surface, forming a largely vertical hole having an upper end in said first element down to said core lower end, and forming a radial groove in said core end which extends to the bottom of said helical groove;

placing said core in said cylindrical hole; and coupling first and second electrically conductive members respectively to said upper end of said helical groove and to said upper end of said vertical hole.

4. A high voltage gas isolator comprising:

a first element which includes a core of dielectric material having a cylindrical periphery and having opposite ends including a bottom end;

a second element which includes a sleeve of dielectric material having a cylindrical hole of the same diameter as said core and which closely receives said core, said second element forming a bottom surface at the bottom of said hole, the bottom end of said core lying facewise against said bottom surface;

said core having a substantially helical groove in its periphery, forming a largely helical passage between said core and sleeve, said helical passage having top and bottom ends;

said core has an axis centered on its cylindrical periphery and said core has a largely vertical hole with a top extending parallel to said axis to said core bottom end, said bottom end of said helical passage lying at said core bottom end, and said core has a groove in said core bottom end that extends from said vertical hole to said bottom end of said helical passage;

means forming a passageway coupled to said top end of said helical passage for passing gas that passes through said helical passage; and a pair of electrically conductive members respectively coupled to the top of said vertical hole and to said means forming a passageway.

5. A high voltage gas isolator comprising:

a first element which includes a core of dielectric material having a cylindrical periphery and having upper and lower core ends;

a second element which includes a sleeve of dielectric material having a cylindrical hole of the same diameter as said core and which closely receives said core;

said core having a substantially helical groove in its periphery, forming a largely helical passage between said core and sleeve, said helical passage having upper and lower ends, said core forming a substantially circular groove portion that extends from said upper end of said helical passage;

said second element has a bottom end and has an axis centered on said cylindrical hole, and said second element includes a largely vertical hole with a hole bottom at said second element bottom end, said second element having a largely radial groove extending from said cylindrical hole of said sleeve to said vertical hole in said second element, said radial groove lying at the same height above said bottom surface as the height of said circular groove portion of said core, whereby the core groove portion and sleeve hole are in communication despite slight changes in angular orientation of the core in the sleeve; and a pair of electrically conductive members respectively coupled to the bottom of said helical passage and the bottom of said vertical hole in said second element.

6. A high voltage gas isolator comprising:

a first element which includes a core of dielectric material having a cylindrical periphery;

a second element which includes a sleeve of dielectric material having an axis and a cylindrical hole centered on said axis and of the same diameter as said core and which closely receives said core;

said core having a substantially helical groove in its periphery, forming a largely helical passage between said core and sleeve, said helical passage having first and second opposite ends;

said second element having a bottom wall with a lower surface, and a largely vertical hole extending through said sleeve to the bottom surface of said second element, said vertical hole having an upper end coupled to said first end of said helical passage, said lower surface of said second element having a groove extending substantially radially to substantially said axis; and including an electrically conductive top plate and means coupling said top plate to said second end of said helical passage; and an electrically conductive bottom plate having an upper surface that lies facewise against said second element lower surface, said bottom plate having a largely radially extending hole with an inner end lying substantially on said axis, and said bottom plate having a substantially axially extending hole coupling said groove in said second element bottom surface to said radially extending hole in said bottom plate, whereby to assure an open passage without requiring high accuracy in the relative rotational orientation of said second element and said bottom plate.

* * * * *